US008181833B2

(12) United States Patent
Wangeby et al.

(10) Patent No.: US 8,181,833 B2
(45) Date of Patent: May 22, 2012

(54) HARNESS FOR BACKPACK VACUUM CLEANER AND THE LIKE

(75) Inventors: Percy Wangeby, Åmål (SE); Andreas Jarl, Karlstad (SE)

(73) Assignee: Nilfisk-Advance A/S, Broendby (DK)

( * ) Notice: Subject to any disclaimer, the term of this patent is extended or adjusted under 35 U.S.C. 154(b) by 1162 days.

(21) Appl. No.: 11/872,820

(22) Filed: Oct. 16, 2007

(65) Prior Publication Data

US 2009/0095780 A1 Apr. 16, 2009

(51) Int. Cl.
*A45F 3/14* (2006.01)

(52) U.S. Cl. ..... 224/627; 224/637; 224/262; 224/264; 224/628

(58) Field of Classification Search ..... 224/261–264, 224/625–628, 636, 637, 648
See application file for complete search history.

(56) References Cited

U.S. PATENT DOCUMENTS

| | | | | |
|---|---|---|---|---|
| 1,803,160 | A | 4/1931 | Adams | |
| 3,165,774 | A | 1/1965 | Barba | |
| 3,180,071 | A | 4/1965 | Nolte | |
| 4,011,624 | A | 3/1977 | Proett | |
| 4,216,563 | A | 8/1980 | Cyphert | |
| 4,287,635 | A | 9/1981 | Jacobs | |
| 4,314,385 | A | 2/1982 | Wimsatt et al. | |
| 4,393,536 | A | 7/1983 | Tapp | |
| 4,513,470 | A | 4/1985 | Toya | |
| 4,688,293 | A | 8/1987 | McCambridge | |
| 4,944,065 | A | 7/1990 | Svanberg et al. | |
| 5,005,251 | A | 4/1991 | McLeod et al. | |
| 5,050,264 | A | 9/1991 | Breslin | |
| 5,586,705 | A * | 12/1996 | Leonard | 224/631 |
| 5,588,177 | A | 12/1996 | Eriksen | |
| 5,954,253 | A * | 9/1999 | Swetish | 224/631 |
| RE37,081 | E | 3/2001 | Eriksen | |
| 6,243,912 | B1 | 6/2001 | Grey | |
| 6,290,111 | B1 * | 9/2001 | Hedenberg et al. | 224/262 |
| 6,393,656 | B1 | 5/2002 | Paterson et al. | |
| 6,553,610 | B1 | 4/2003 | Shideler | |
| 7,198,186 | B2 * | 4/2007 | Kling et al. | 224/628 |
| 7,287,300 | B2 | 10/2007 | Rupp et al. | |
| 7,337,935 | B1 * | 3/2008 | Glanville | 224/628 |
| 2004/0007605 | A1 * | 1/2004 | Mares | 224/630 |
| 2007/0044270 | A1 | 3/2007 | Crevling et al. | |

OTHER PUBLICATIONS

Advance CaniStar TM Canister Dry Vacuum, Nilfisk-Advance, Inc., Mar. 2004, two pages.

* cited by examiner

*Primary Examiner* — Justin Larson
*Assistant Examiner* — Adam Waggenspack
(74) *Attorney, Agent, or Firm* — Alan Kamrath; Kamrath IP Lawfirm, PA

(57) ABSTRACT

A harness (10) for a backpack vacuum cleaner (100) includes a back plate (20) mounted to a vacuum cleaner body (102). The back plate (20) includes an intermediate portion (22) and two flexible sections (24) on opposite sides of the intermediate portion (22). A waist strap (90) is fixed to the back plate (20) between the flexible sections (24). The flexible sections (24) are flexible to respectively pivot about two spaced vertical pivot axes (72). Upper ends (82) of two shoulder straps (80) are attached to a mounting plate (50) slideably mounted to the back plate (20), and lower ends (84) of the shoulder straps (80) are attached to the flexible sections (24). Relative positions between the upper and lower ends (82 and 84) of the shoulder straps (80) can be adjusted by moving the mounting plate (50). When a user moves his or her shoulders, the connection points (32) of the flexible sections (24) flex to respectively pivot about the pivot axes (72).

15 Claims, 4 Drawing Sheets

HARNESS FOR BACKPACK VACUUM CLEANER AND THE LIKE

BACKGROUND OF THE INVENTION

The present invention relates to a harness especially adaptable for use with a backpack vacuum cleaner and, more particularly, to a harness for a backpack vacuum cleaner allowing free movement of shoulders of a user.

Harnesses of different types have been developed for vacuum cleaners to assist in carriage by users. A simple waist belt is enough for carrying a small size vacuum cleaner, while a larger vacuum cleaner requires shoulder straps for additional support. The weight of a backpack vacuum cleaner is carried mainly by the shoulder straps whose upper ends are fixed to the vacuum cleaner, leading to limitations to movement of the shoulders of the user as well as fatigue. Lower ends of the shoulder straps are fixed to the vacuum cleaner or a waist belt in an inflexible way even though the shoulder straps are adjustable in length. In a variation of the harness, the shoulder straps and the waist belt are mounted to the same back plate fixed to a vacuum cleaner tank, and lower ends of the shoulder straps are mounted to the waist belt, also leaving few adjustment possibilities as well as limited shoulder movement of the user. In another variation of the harness, the shoulder straps are mounted to a back plate at a point very close to the mounting point of the waist belt leaving very little flexibility as well as limited adjustment possibilities, for the upper mounting points of the shoulder straps are fixed with respect to the waist belt. In still another variation of the harness, the fixing points for shoulder straps are adjustable; however, only few positions are possible, and screws for adjusting the shoulder straps must be removed with tools.

Therefore, a need exists for a harness for a backpack vacuum cleaner allowing free movement of the shoulders of the user and obviating fatigue resulting from the shoulder straps.

BRIEF SUMMARY OF THE INVENTION

The present invention solves this need and other problems in the field of backpack vacuum cleaners by providing, in a preferred form, a harness for a backpack vacuum cleaner including a back plate adapted to be mounted to a body of a vacuum cleaner. The back plate includes an intermediate portion and two flexible sections on opposite sides of the intermediate portion. The flexible sections are flexible to respectively pivot relative to the opposite sides of the intermediate portion about two pivot axes spaced from each other and on opposite sides of a vertical direction. A mounting plate is slideably mounted to the back plate. The harness further includes two shoulder straps each having an upper end attached to the mounting plate and a lower end attached to one of the flexible sections at a connection point. The mounting plate is slideable in the vertical direction relative to the back plate to adjust positions of the upper ends of the shoulder straps relative to the lower ends of the shoulder straps in the vertical direction. A waist strap is fixed to the back plate between the connection points and adapted to be mounted around a waist of a user. The connection points of the flexible sections flex to respectively pivot about the pivot axes when the user moves his or her shoulders relative to his or her waist. The connection points of the flexible sections may also flex to pivot about a horizontal direction perpendicular to the vertical direction.

In the most preferred form, each flexible section is triangular in shape and attached to the intermediate portion about a fold line that defines one of the pivot axes along a vertical side of the triangular shape of the flexible section. The connection points are on opposite corners of the triangular shapes of the flexible portions distant to the vertical sides of the triangular shapes of the flexible sections. Each flexible section includes a plurality of openings extending from a side of the back plate through the other side of the back plate in a direction perpendicular to the vertical direction and the horizontal direction for providing the flexible sections with flexibility. A screw includes a head on a side of the back plate and a shank slideably extended from the head through a vertically extending groove in the back plate to the other side of the back plate and fixed to the mounting plate, allowing sliding movement of the mounting plate in the vertical direction when the upper ends of the shoulder straps are moved. The waist strap is fixed to the back plate at a coupling section spaced from the connection points. An area between each connection point and the coupling section is free of connection with the waist strap.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
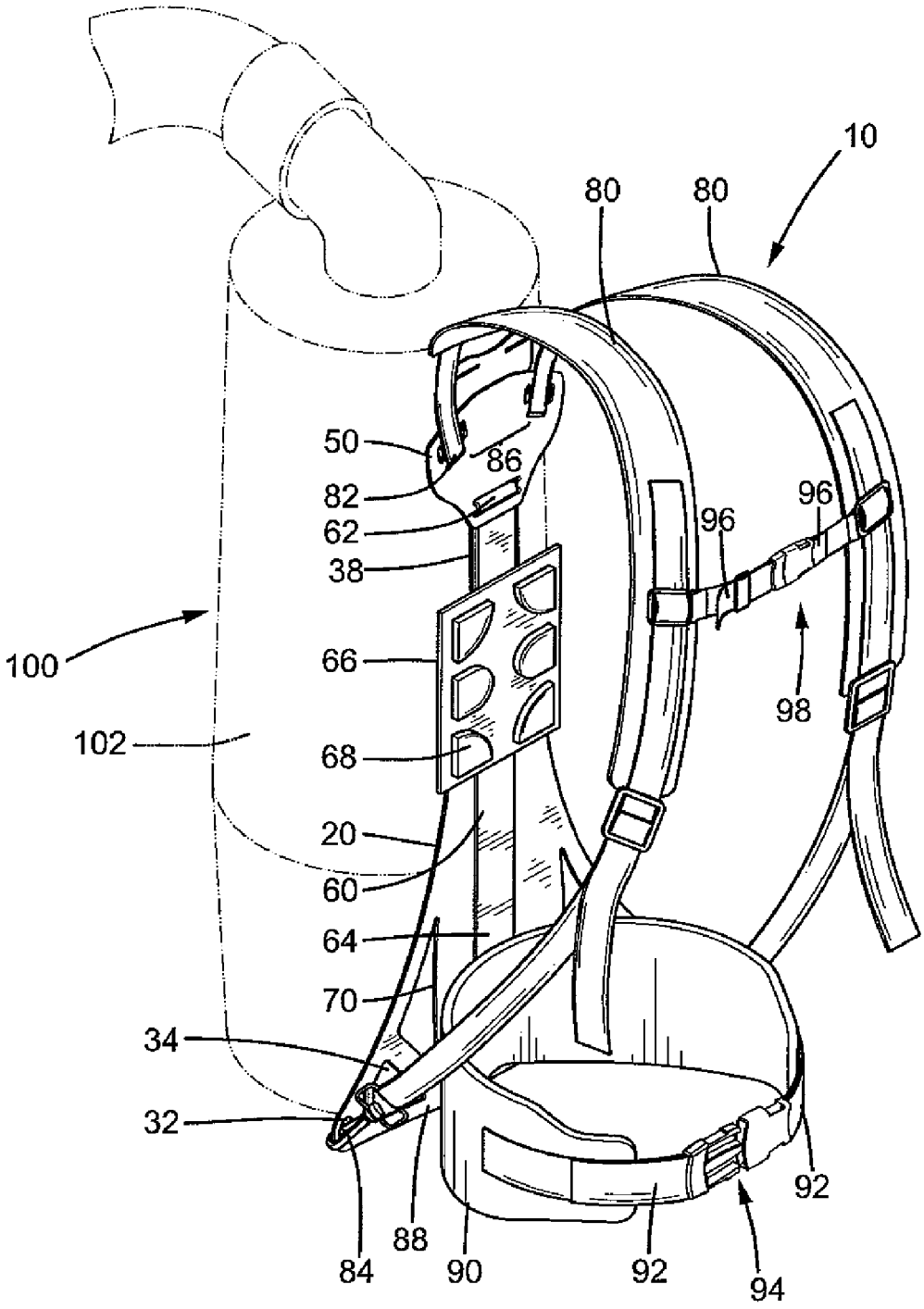
FIG. 1 shows a perspective view of a harness according to the preferred teachings of the present invention in use with a backpack vacuum cleaner shown in phantom.
Figure 2:
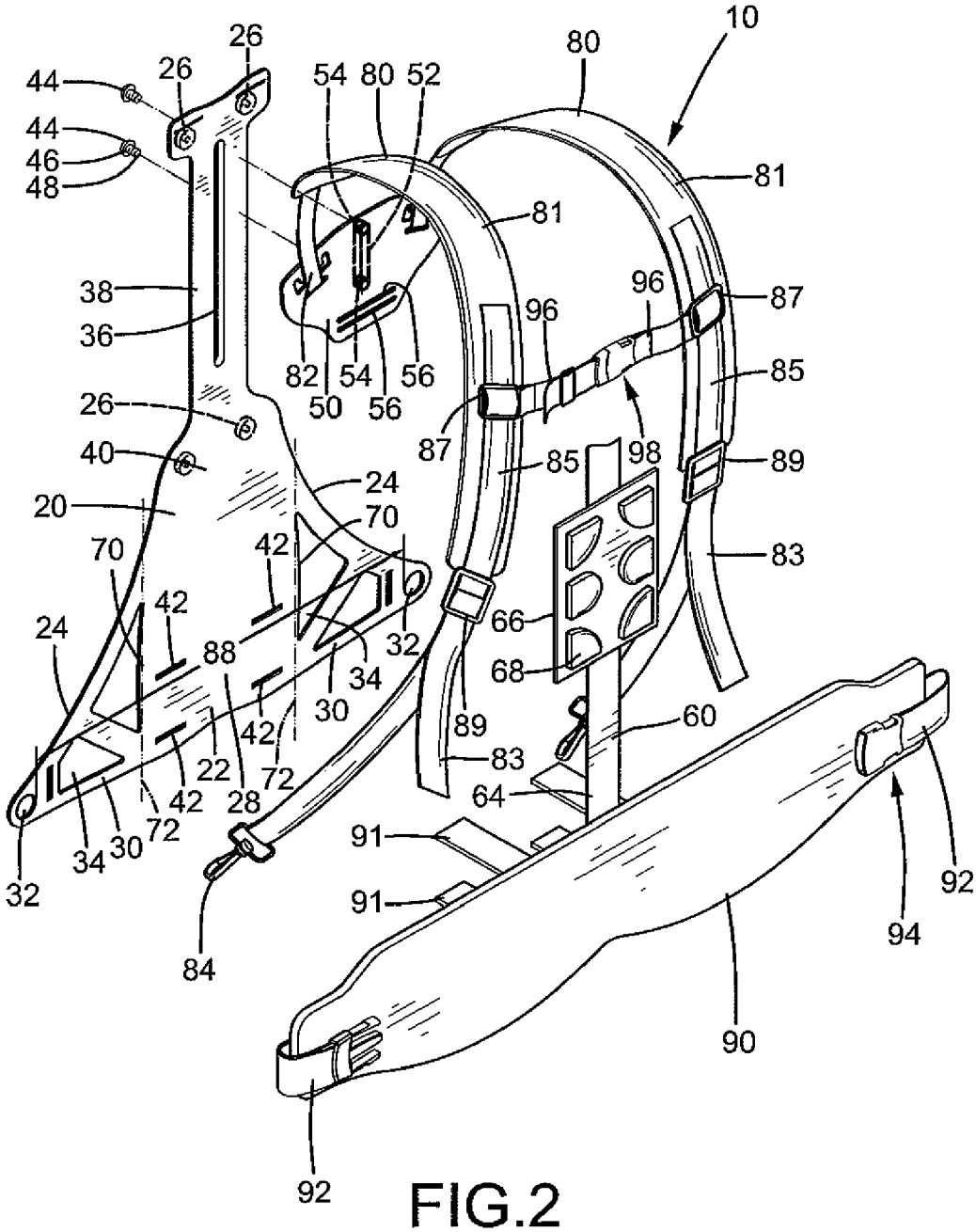
FIG. 2 shows an exploded perspective view of the harness of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "end", "portion", "section", "horizontal", "vertical", "outward", "spacing", "length", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A harness for a backpack vacuum cleaner according to the preferred teachings of the present invention is shown in the drawings and generally designated 10. The backpack vacuum cleaner 100 is of a weight and a size suitable to be carried by a user with his or her waist and shoulders for easy carriage and/or easy use. The backpack vacuum cleaner 100 can be of any type and performs cleaning operations.

The harness 10 generally includes a back plate 20 to be mounted to a body 102 of the vacuum cleaner 100. The back plate 20 may be spaced from the body 102 by spacers 26. In the preferred form shown, the back plate 20 includes a substantially bell-shaped intermediate portion 22 having a width extending in a horizontal direction perpendicular to the vertical direction. The intermediate portion 22 includes an upper section 38 and a lower section 40. The upper section 38 includes a groove 36 extending in the vertical direction. Furthermore, the upper section 38 is narrower than the lower section 40 to avoid hindrance to movement of the shoulders of the user. Two flexible sections 24 are respectively attached to two opposite sides of the lower section 40 of the intermediate portion 22 about two vertical fold lines 70 each defining a vertical pivot axis 72. In the most preferred form shown, each flexible section 24 is substantially a triangle formed on one of the vertical sides of the lower section 40 of the intermediate portion 22, with each pivot axis 72 being along a vertical side of the triangular shape. The triangular shape of each flexible section 24 has a corner 32 distant to the vertical side forming the pivot axis 72. The lower section 40 and the flexible sections 24 together form a triangle. Each flexible section 24 includes a plurality of openings 34 extending in a direction perpendicular to the vertical and horizontal directions to provide the flexible sections 24 with flexibility. The lower section 40 of the intermediate portion 22 further includes a plurality of slots 42 extending in a direction perpendicular to the vertical and horizontal directions.

A mounting plate 50 is slideably mounted to the upper section 38 of the back plate 20. In the preferred form shown, the mounting plate 50 includes a protrusion 52 on a side thereof facing a side of the back plate 20. The protrusion 52 includes two screw holes 54 in upper and lower ends thereof. Two screws 44 are provided and each include a head 46 on the other side of the back plate 20 and a shank 48 slideably extending from the head 46 through the groove 36 of the back plate 20 to the side of the back plate 20 and engaged with the screw holes 54 of the mounting plate 50. Thus, the mounting plate 50 is slideable relative to the back plate 20 in the vertical direction. The mounting plate 50 can be retained in place by friction between the shanks 48 of the screws 44 and two vertical edges defining the groove 36 of the back plate 20. Other arrangements for retaining the mounting plate 50 in place or allowing free sliding movement of the mounting plate 50 relative to the back plate 20 would be within the skill of the art. In the most preferred form shown, the mounting plate 50 further includes two vertically spaced horizontal slots 56 located below the protrusion 52 and extending from a side of the mounting plate 50 through the other side of the mounting plate 50.

According to the preferred form shown, the harness 10 further includes two length-adjustable shoulder straps 80 including upper ends 82 respectively fixed to two opposite sides of the mounting plate 50 and having a spacing 86 therebetween. Lower ends 84 (in the most preferred form shown as hooks) of the shoulder straps 80 are fixed to the corners 32 of the flexible sections 24 and have a spacing 88 therebetween. The spacing 88 between the lower ends 84 of the shoulder straps 80 is at least two times larger than the spacing 86 between the upper ends 82 of the shoulder straps 80 and is wider than the waist of the user so as not to affect movement of the waist and shoulders of the user. The connection points between the lower ends 84 of the shoulder straps 80 and the flexible sections 24 can be arranged in positions other than the corners 32 according to needs. In the most preferred form shown, each shoulder strap 80 includes an upper strap 81 having the upper end 82, a lower strap 83 having the lower end 84, and a connecting strap 85 having an upper end sewn to an intermediate section of the upper strap 81. A buckle 87 is mounted on the connecting strap 85 to allow adjustment of the length of the connecting strap 85. Another buckle 89 is sewn to a lower end of the connecting strap 85. An upper end of the lower strap 83 is adjustably attached to the buckle 87 to allow adjustment of the length of the lower strap 83. The overall length of each shoulder strap 80 can be adjusted by adjusting positions of the buckles 87 and 89. It can be appreciated that the shoulder straps 80 can be but not limited to any commercially available length-adjustable types. A connecting strip 96 has an end fixed to the intermediate section of each upper strap 81. A buckle device 98 is provided on distal ends of the connecting strips 96 for easy, releasable engagement of the connecting strips 96 around a chest of the user. Other forms of the connecting strips 96 and devices for releasable coupling the connecting strips 96 would be within the skill of the art.

In the preferred form shown, a waist strap 90 is fixed to the intermediate portion 22 of the back plate 20 at a coupling section 28 within the width of the intermediate portion 22 and spaced from the corners 32 of the flexible sections 24 of the back plate 20. A plurality of elongated strips 91 extend from a rear face of the waist strap 90 through the slots 42 in the lower section 40 of the intermediate portion 22 to fix the waist strap 90 to the back plate 20. Other arrangements for fixing the waist strap 90 to the back plate 20 would be within the skill of the art. An area 30 between each corner 32 and the coupling section 28 is free of connection with the waist strap 90. The openings 34 of each flexible section 24 are located in one of the areas 30. In the most preferred form shown, each area 30 has an extent greater than the spacing of the lower end 84 of an adjacent shoulder strap 80 from an adjacent fold line 70. The waist strap 90 can be mounted around the waist of the user for carrying the backpack vacuum cleaner 100. The waist strap 90 includes two elongated strips 92 extending outward from two opposite sides thereof, with the elongated strips 92 having a buckle device 94 formed thereon for easy, releasable engagement of the strips 92 around the waist of the user. Other forms of the elongated strips 92 and devices for releasable coupling the elongated strips 92 would be within the skill of the art. The main weight of the backpack vacuum cleaner 100 is carried by the waist strap 90. Other forms of waist straps 90 would be within the skill of the art.

In the most preferred form shown, the harness 10 further includes a length-adjustable strap 60 having an upper end 62 mounted to the mounting plate 50 to move therewith and a lower end 64 fixed to the back plate 20. The lower end 64 of the strap 60 may be fixed to the back plate 20 by sewing to the waist strap 90 or by screws that hold the back plate 20 on the body 102 of the backpack vacuum cleaner 100. The strap 60 extends vertically along the intermediate portion 22 of the back plate 20 between the shoulder straps 80. The upper end 62 of the strap 60 is adjustably extended through the horizontal slots 56 of the mounting plate 50. Thus, the length of the strap 60 can be adjusted so that the vertical position of the mounting plate 50 can be adjusted according to a body length of the user. Such an adjustment can be easily accomplished whenever necessary without the use of tools. The strap 60 can be but not limited to any commercially available length-adjustable types. A pad 66 is attached to an intermediate section between the upper and lower ends 62 and 64 of the strap 60 and includes a plurality of protrusions 68 on an outer face for providing comfort contact with the back of the user.

Now that the basic construction of the harness for a backpack vacuum cleaner 10 of the preferred teachings of the present invention has been explained, the operation and some of the advantages of the harness 10 according to the preferred teachings of the present invention can be set forth and appreciated. The backpack vacuum cleaner 100 is placed upright on a floor, and a user adjusts the length of the strap 60 and/or the lengths of the shoulder straps 80 according to his or her body length. Specifically, the position of the upper end 62 of the strap 60 relative to the horizontal slots 56 of the mounting plate 50 is adjusted according to the body length of the user. Also, the overall length of each shoulder strap 80 is adjusted by adjusting positions of the buckles 87 and 89 according to the body length of the user. Then, the user mounts the backpack vacuum cleaner 100 onto his or her back after lifting the shoulder straps 80 and, hence, the mounting plate 50 upward, with the shoulder straps 80 on the shoulders. The connecting strips 96 are tightened around the chest of the user by the buckle device 98. The elongated strips 92 of the waist strap 90 are tightened around the waist of the user by the buckle device 94. The strap 60 prevents the mounting plate 50 from separating beyond the set amount. The main weight of the backpack vacuum cleaner 100 is carried by the waist strap 90, avoiding fatigue resulting from the shoulder straps 80.

Figure 3:
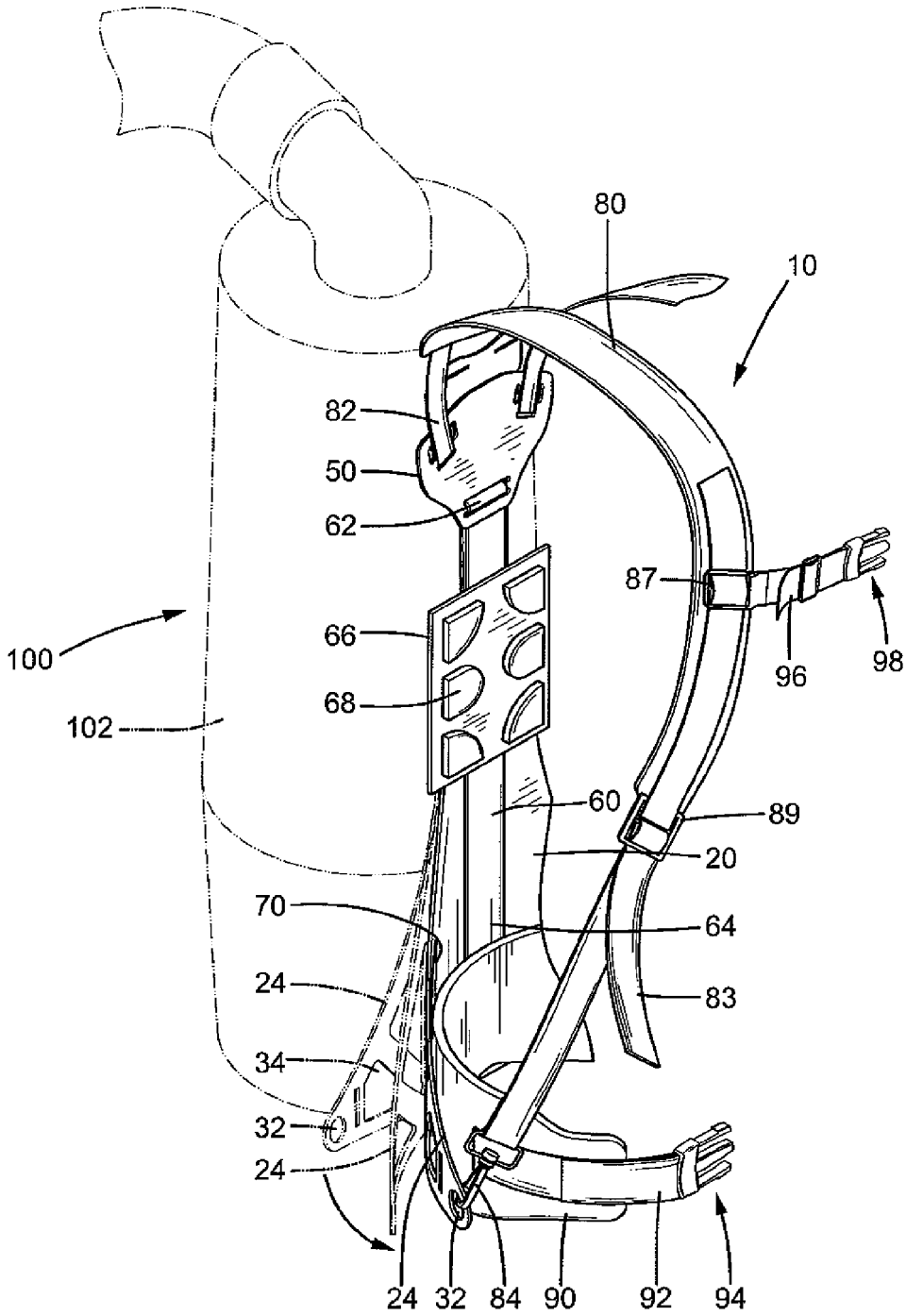
FIG. 3 shows a partial, perspective view of the harness of FIG. 1 with a back plate of the harness flexed to pivot about a vertical direction with the backpack vacuum cleaner shown in phantom.
Figure 4:
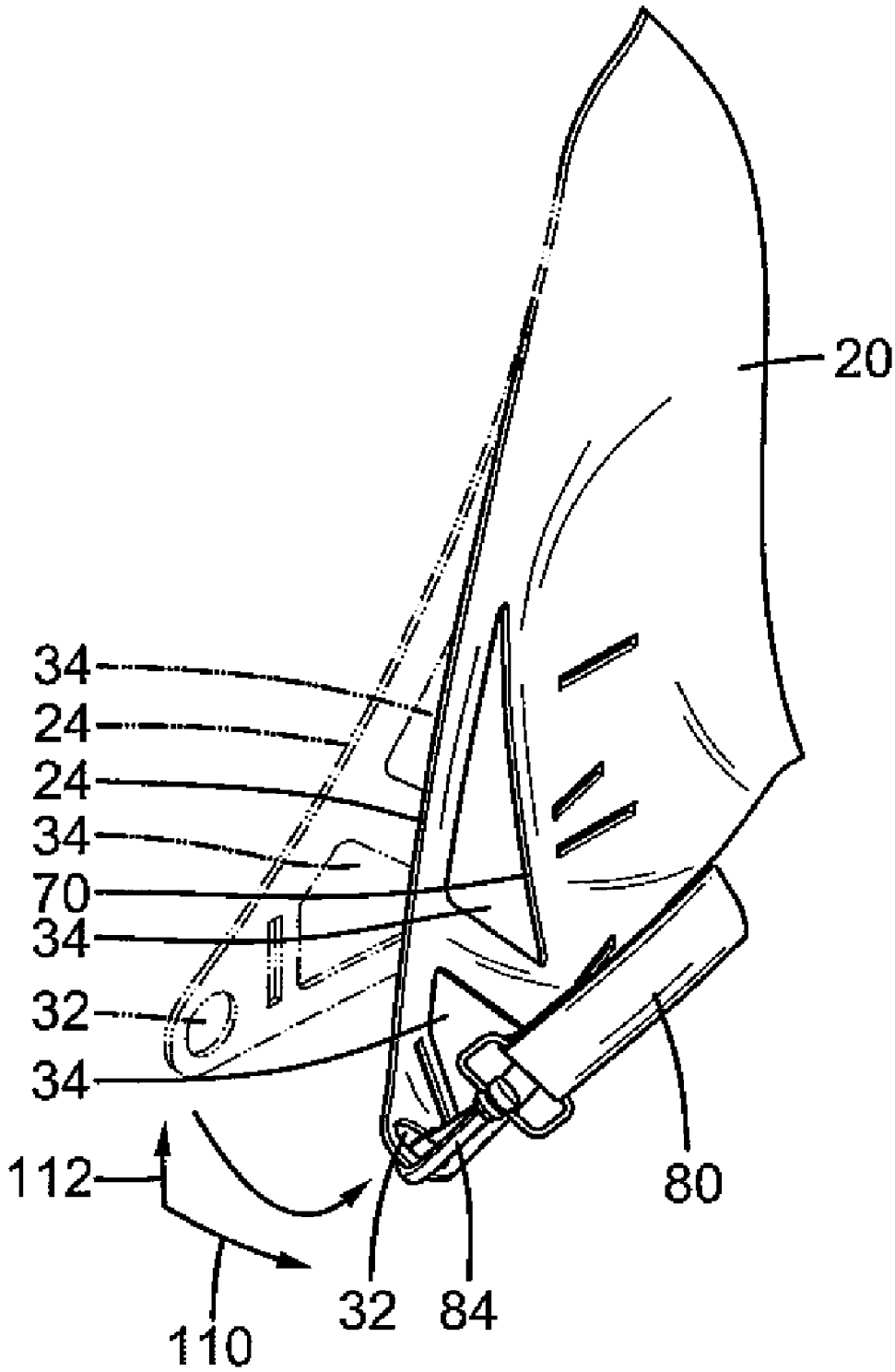
FIG. 4 shows a partial, perspective view of the harness of FIG. 1 with the back plate of the harness flexed to pivot about vertical and horizontal directions.

When the user moves his or her shoulders relative to his or her waist, the flexible sections 24 curl, and the corners 32 of the flexible sections 24 pivot about the pivot axes 72 (see FIG. 3). The corners 32 of the flexible sections 24 mainly pivot about the pivot axes 72 extending in the vertical direction. Although the corners 32 of the flexible sections 24 mainly pivot about the pivot axes 72 extending in the vertical direction, the corners 32 of the flexible sections 24 may also pivot about the horizontal direction to allow free movement of the shoulders of the user in the vertical direction. Specifically, each flexible section 24 may flex in a horizontal plane (see the horizontal component 110 shown in FIG. 4) as well as in a vertical plane (see the vertical component 112 shown in FIG. 4). Also, flexible movement of the lower ends 84 of the shoulder straps 80 relative to the waist strap 90 is allowed, since the area 30 between each corner 32 and the coupling section 28 is free of connection with the waist strap 90, allowing the flexible sections 24 to pivot relative to the waist strap 90. Thus, free movement of the shoulders of the user is allowed, providing comfort during use.

Now that the basic teachings of the present invention have been explained, many extensions and variations will be obvious to one having ordinary skill in the art. For example, flexibility of the flexible sections 24 can be provided by other suitable arrangements. Furthermore, the shapes of the flexible sections 24 can be varied according to user needs. The back plate 20 and the mounting plate 50 can be produced with any suitable materials.

The harness 10 according to the preferred teachings of the present invention can be produced at low costs and can be easily mounted to any currently available backpack vacuum cleaner at low costs. Adjustment of the strap 60 and the shoulder straps 80 according to the body length of the user can be easily accomplished without tools. The length of the waist strap 90 can also be easily adjusted according to the waist size of the user without tool. The harness 10 according to the preferred teachings of the present invention allows free movement of the shoulders of the user while providing comfort during use.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A harness for a backpack vacuum cleaner comprising, in combination:

a back plate adapted to be mounted to a body desired to be carried on a back of a user;

a mounting plate slideably mounted in a vertical direction to the back plate;

two shoulder straps each including an upper end attached to the mounting plate to move therewith and a lower end attached to the back plate and below and spaced from the upper end in the vertical direction, with the lower end of each of the two shoulder straps being attached to the back plate at a connection point, with the mounting plate being slideable in the vertical direction relative to the back plate to adjust positions of the upper ends of the two shoulder straps relative to the lower ends of the two shoulder straps in the vertical direction;

a length-adjustable strap including an upper end mounted to the mounting plate to move therewith and a lower end fixed relative to the back plate, with the strap extending vertically along an intermediate portion of the back plate between the two shoulder straps, and with the strap being adjustable in length according to a body length of the user, with the connection points being spaced from each other and on opposite sides of the vertical direction;

a waist strap fixed to the back plate between the connection points and adapted to be mounted around a waist of the user for carrying the body, with the back plate including an intermediate portion and two flexible sections attached on two opposite sides of the intermediate portion by two fold lines defining two pivot axes, with the connection points located on the two flexible sections, with the two flexible portions respectively pivotable relative to the two opposite sides of the intermediate portion about the two pivot axes, with the two flexible portions being flexible to curl intermediate the connection parts and the two fold lines, and with the connection points moving due to the two flexible sections flexing to curl and folding about the two fold lines to pivot about the two pivot axes spaced from each other and on the opposite sides of the vertical direction due to movement of shoulders of the user, with the back plate including a groove extending in the vertical direction; and a screw including a head on a side of the back plate and a shank slideably extending from the head through the groove to another side of the back plate and fixed to the mounting plate.

2. The harness for a backpack vacuum cleaner as claimed in claim 1, with the connection points of the back plate where the lower ends of the two shoulder straps are attached having a first spacing therebetween in a horizontal direction perpendicular to the vertical direction, with the upper ends of the two shoulder straps being connected to the mounting plate at two spaced connection points having a second spacing therebetween in the horizontal direction, and with the first spacing being at least two times larger than the second spacing.

3. The harness for a backpack vacuum cleaner as claimed in claim 2, with the two flexible sections being substantially triangular in shape, with each of the two pivot axes being along a side of the triangular shape of one of the two flexible sections, with the connection points being on opposite corners of the triangular shapes of the two flexible sections, and with the connection points of the two flexible sections flexing to pivot about a horizontal direction perpendicular to the vertical direction due to movement of the shoulders of the user.

4. The harness for a backpack vacuum cleaner as claimed in claim 3, with each of the two flexible sections of the back plate including a plurality of openings extending from a side of the back plate through another side of the back plate in a direction perpendicular to the vertical direction and the horizontal direction for providing the two flexible sections with flexibility.

5. The harness for a backpack vacuum cleaner as claimed in claim 3, with the waist strap being fixed to the back plate at a coupling section spaced from the connection points, with an area between each of the connection points and the coupling section being free of connection with the waist strap, and with the area extending inwardly of the two pivot axes.

6. The harness for a backpack vacuum cleaner as claimed in claim 5, with the two shoulder straps being adjustable in length.

7. The harness for a backpack vacuum cleaner as claimed in claim 2, with the two flexible sections being triangular in shape, with each of the two pivot axes being along a side of the triangular shape of one of the two flexible sections, with the connection points being on opposite corners of the triangular shapes of the two flexible sections distant to the sides of the triangular shapes of the two flexible sections, and with the connection points of the two flexible sections folding about the two fold lines to pivot about a horizontal direction perpendicular to the two pivot axes due to movement of the shoulders of the user.

8. The harness for a backpack vacuum cleaner as claimed in claim 7, with each of the two flexible sections of the back plate including a plurality of openings extending from a side of the back plate through another side of the back plate in a direction perpendicular to the two pivot axes and the horizontal direction for providing the two flexible sections with flexibility.

9. The harness for a backpack vacuum cleaner as claimed in claim 2, with the waist strap being fixed to the back plate at a coupling section spaced from the connection points, with an area between each of the connection points and the coupling section being free of connection with the waist strap, and with the area extending inwardly of the two pivot axes.

10. The harness for a backpack vacuum cleaner as claimed in claim 9, with the two shoulder straps being adjustable in length.

11. The harness for a backpack vacuum cleaner as claimed in claim 1, with the two flexible sections being triangular in shape, with each of the two pivot axes being along a side of the triangular shape of one of the two flexible sections, with the connection points being on opposite corners of the triangular shapes of the two flexible sections, and with the connection points of the two flexible sections flexing to pivot about a horizontal direction perpendicular to the vertical direction due to movement of the shoulders of the user.

12. The harness for a backpack vacuum cleaner as claimed in claim 11, with the connection points of the back plate where the lower ends of the two shoulder straps are attached having a first spacing therebetween in a horizontal direction perpendicular to the vertical direction, with the upper ends of the two shoulder straps being connected to the mounting plate at two spaced connection points having a second spacing therebetween in the horizontal direction, and with the first spacing being at least two times larger than the second spacing.

13. The harness for a backpack vacuum cleaner as claimed in claim 11, with each of the two flexible sections of the back plate including a plurality of openings extending from a side of the back plate through another side of the back plate in a direction perpendicular to the vertical direction and the horizontal direction for providing the two flexible sections with flexibility.

14. The harness for a backpack vacuum cleaner as claimed in claim 1, with the waist strap being fixed to the back plate at a coupling section spaced from the connection points, with an area between each of the connection points and the coupling section being free of connection with the waist strap, and with the area extending inwardly of the two pivot axes.

15. The harness for a backpack vacuum cleaner as claimed in claim 14, with the two shoulder straps being adjustable in length.

* * * * *